US010850502B2

(12) United States Patent
Anderson et al.

(10) Patent No.: US 10,850,502 B2
(45) Date of Patent: Dec. 1, 2020

(54) FLUIDIC DIE WITH PRIMITIVE SIZE GREATER THAN OR EQUAL TO EVALUATOR SUBSET

(71) Applicant: HEWLETT-PACKARD DEVELOPMENT COMPANY, L.P., Spring, TX (US)

(72) Inventors: Daryl E Anderson, Corvallis, OR (US); Eric Martin, Corvallis, OR (US); James Michael Gardner, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/613,183

(22) PCT Filed: Jul. 11, 2017

(86) PCT No.: PCT/US2017/041471

§ 371 (c)(1),
(2) Date: Nov. 13, 2019

(87) PCT Pub. No.: WO2019/013760

PCT Pub. Date: Jan. 17, 2019

(65) Prior Publication Data

US 2020/0198323 A1 Jun. 25, 2020

(51) Int. Cl.
*B41J 2/04* (2006.01)
*B41J 2/045* (2006.01)

(52) U.S. Cl.
CPC ..... *B41J 2/0451* (2013.01); *B41J 2/0458* (2013.01); *B41J 2/04581* (2013.01)

(58) Field of Classification Search
CPC .. B41J 2/04543; B41J 2/04545; B41J 2/0451; B41J 2/04513; B41J 2/04515;
(Continued)

(56) References Cited

U.S. PATENT DOCUMENTS 5,121,688 A * 6/1992 Williams ..... B41C 1/1033 101/142
6,076,910 A 6/2000 Anderson et al.
(Continued)

FOREIGN PATENT DOCUMENTS

WO WO-2015080709 A1 6/2015

OTHER PUBLICATIONS

Kim, S et al, Development of Inkjet Nozzle Driven by Double Piezo Actuators, 2012, < http://www.itmo.by/pdf/isfv/ISFV15-063.pdf >.

*Primary Examiner* — Kristal Feggins
(74) *Attorney, Agent, or Firm* — Fabian VanCott

(57) ABSTRACT

In one example in accordance with the present disclosure, a fluidic die is described. The die includes an array of fluid actuators grouped into primitives. The die also includes an array of actuator evaluators, wherein each actuator evaluator of the fluidic die is coupled to a subset of the array of fluid actuators. A fluid actuator controller groups multiple fluid actuators of the array of fluid actuators into primitives. A primitive size is greater than or equal to a lower limit threshold and the subset of the array of fluid actuators coupled to the actuator evaluation device is less than or equal to the lower limit threshold.

15 Claims, 5 Drawing Sheets

(58) Field of Classification Search
CPC .. B41J 2/0452; B41J 2/04525; B41J 2/04526; B41J 2/04568; B41J 2/04548; B41J 2/04555; B41J 2/0456; B41J 2/0458; B41J 2/04565
See application file for complete search history.

(56) References Cited

U.S. PATENT DOCUMENTS

| | | | | |
|---|---|---|---|---|
| 7,465,005 | B2 | 12/2008 | Walmsley et al. | |
| 8,371,676 | B2 | 2/2013 | Shinkawa et al. | |
| 2006/0274103 | A1* | 12/2006 | Kim | B41J 2/04563 347/17 |
| 2008/0309712 | A1* | 12/2008 | Silverbrook | B41J 2/1631 347/42 |
| 2013/0162702 | A1* | 6/2013 | Tombs | G03G 8/00 347/1 |
| 2013/0176355 | A1 | 7/2013 | Kritchman et al. | |
| 2014/0204148 | A1* | 7/2014 | Ge | G01F 23/263 347/19 |

* cited by examiner

FLUIDIC DIE WITH PRIMITIVE SIZE GREATER THAN OR EQUAL TO EVALUATOR SUBSET

BACKGROUND

A fluidic die is a component of a fluid ejection system that includes a number of fluid ejecting nozzles. The die can also include other non-ejecting actuators such as micro-recirculation pumps. Through these nozzles and pumps, fluid, such as ink and fusing agent among others, is ejected or moved. Over time, these nozzles and actuators can become clogged or otherwise inoperable. As a specific example, ink in a printing device can, over time, harden and crust. This can block the nozzle and interrupt the operation of subsequent ejection events. Other examples of issues affecting these actuators include fluid fusing on an ejecting element, particle contamination, surface puddling, and surface damage to die structures. These and other scenarios may adversely affect operations of the device in which the fluidic die is installed.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
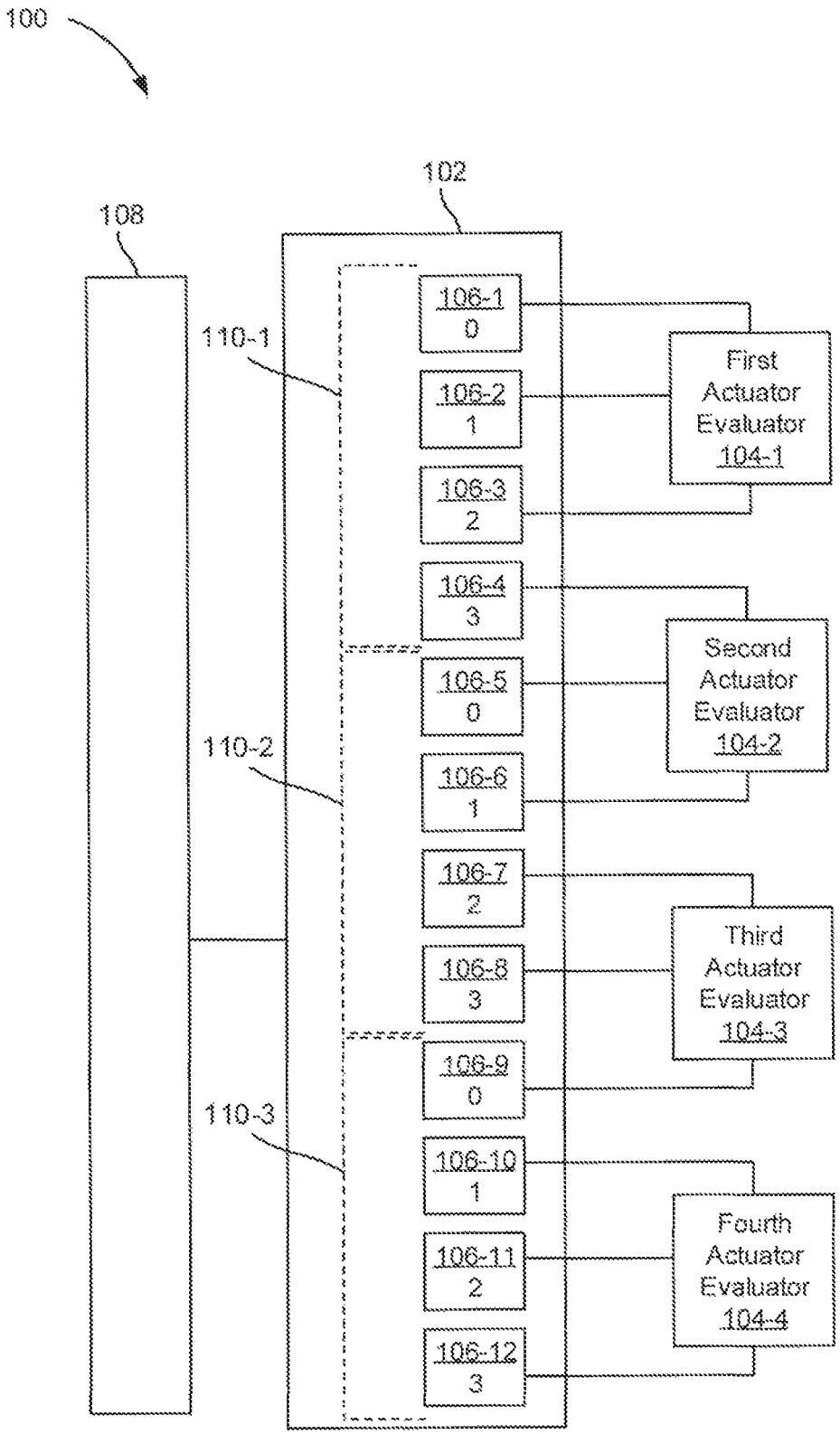
FIG. 1 is a diagram of a fluidic die with a primitive size greater than or equal to an evaluator subset, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Fluidic dies, as used herein, may describe a variety of types of integrated devices with which small volumes of fluid may be pumped, mixed, analyzed, ejected, etc. Such fluidic dies may include ejection dies, such as printheads, additive manufacturing distributor components, digital titration components, and/or other such devices with which volumes of fluid may be selectively and controllably ejected. Other examples of fluidic dies include fluid sensor devices, lab-on-a-chip devices, and/or other such devices in which fluids may be analyzed and/or processed.

In a specific example, these fluidic systems are found in any number of printing devices such as inkjet printers, multi-function printers (MFPs), and additive manufacturing apparatuses. The fluidic systems in these devices are used for precisely, and rapidly, dispensing small quantities of fluid. For example, in an additive manufacturing apparatus, the fluid ejection system dispenses fusing agent. The fusing agent is deposited on a build material, which fusing agent facilitates the hardening of build material to form a three-dimensional product.

Other fluid ejection systems dispense ink on a two-dimensional print medium such as paper. For example, during inkjet printing, fluid is directed to a fluid ejection die. Depending on the content to be printed, the device in which the fluid ejection system is disposed determines the time and position at which the ink drops are to be released/ejected onto the print medium. In this way, the fluid ejection die releases multiple ink drops over a predefined area to produce a representation of the image content to be printed. Besides paper, other forms of print media may also be used.

Accordingly, as has been described, the systems and methods described herein may be implemented in two-dimensional printing, i.e., depositing fluid on a substrate, and in three-dimensional printing, i.e., depositing a fusing agent or other functional agent on a material base to form a three-dimensional printed product.

Returning to the fluid actuators, a fluid actuator may be disposed in a nozzle, where the nozzle includes a fluid chamber and a nozzle orifice in addition to the fluid actuator. The fluid actuator in this case may be referred to as an ejector that, upon actuation, causes ejection of a fluid drop via the nozzle orifice.

Fluid actuators may also be pumps. For example, some fluidic dies include microfluidic channels. A microfluidic channel is a channel of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.). Fluidic actuators may be disposed within these channels which, upon activation, may generate fluid displacement in the microfluidic channel.

Examples of fluid actuators include a piezoelectric membrane based actuator, a thermal resistor based actuator, an electrostatic membrane actuator, a mechanical/impact driven membrane actuator, a magneto-strictive drive actuator, or other such elements that may cause displacement of fluid responsive to electrical actuation. A fluidic die may include a plurality of fluid actuators, which may be referred to as an array of fluid actuators.

The array of fluid actuators may be formed into groups referred to as "primitives." A primitive generally includes a group of fluid actuators that each have a unique actuation address. In some examples, electrical and fluidic constraints of a fluidic die may limit which fluid actuators of each primitive may be actuated concurrently for a given actuation event. Therefore, primitives facilitate addressing and subsequent actuation of fluid ejector subsets that may be concurrently actuated for a given actuation event. A number of fluid ejectors corresponding to a respective primitive may be referred to as a size of the primitive.

To illustrate by way of example, if a fluidic die has four primitives, each respective primitive may have eight respective fluid actuators (the different fluid actuators having an address 0 to 7). In other words, each fluid actuator within a primitive has a unique in-primitive address. In some examples, electrical and fluidic constraints limit simultaneous actuation to one fluid actuator per primitive. Accordingly, a total of four fluid actuators (one from each primitive) may be concurrently actuated for a given actuation event. For example, for a first actuation event, the respective fluid actuator of each primitive having an address of 0 may be actuated. For a second actuation event, the respective fluid actuator of each primitive having an address of 1 may be actuated.

A fluid actuator controller facilitates the actuation of the actuators. For example, a fluid actuator controller may include an actuation data register and a mask register. The actuation data register stores actuation data that indicates fluid actuators to actuate for a set of actuation events. The mask register stores mask data that indicates a subset of fluid actuators of the array of fluid actuators enabled for actuation for a particular actuation event of the set of actuation events. Accordingly, the fluid actuator controller facilitates concurrent actuation of different arrangements of fluid actuators based on the mask data of the mask register. In some examples, the mask data groups fluid actuators, and thereby defines the primitives.

At different points in time, the mask data may change, such that the fluid actuator controller facilitates variable primitive sizes. For example, for a first actuation event, fluid actuators may be arranged in primitives of a first primitive size, as defined by first mask data stored in the mask register, and for a second actuation event, second mask data may be loaded into the mask register such that fluid actuators may be arranged in primitives of a second primitive size.

While such fluid ejection systems and dies undoubtedly have advanced the field of precise fluid delivery, some conditions impact their effectiveness. For example, the actuators on a die are subject to many cycles of heating, drive bubble formation, drive bubble collapse, and fluid replenishment from a fluid reservoir. Over time, and depending on other operating conditions, the actuators may become blocked or otherwise defective. As the process of depositing fluid on a surface is a precise operation, these blockages can have a deleterious effect on print quality. If one of these fluid actuators fail, and is continually operating following failure, then it may cause neighboring actuators to fail.

Accordingly, the present specification is directed to a fluidic die that 1) determines the state of a particular fluid actuator and 2) allows for varying the primitive size. That is, the present specification describes a die wherein a certain number of fluid actuators are coupled to an actuator evaluator to determine a state of the actuator. However, an actuator evaluator evaluates one actuator at a time. Accordingly, as the primitive size can vary, if the primitive size is smaller than the number of fluid actuators coupled to an actuator evaluator, it may be possible that multiple actuators coupled to an actuator evaluator may be selected for evaluation. For example, given a primitive size of 3 having addresses 0, 1, and 2, and given four actuators coupled to an actuator evaluator, it could be possible that two actuators, having address 0 from a first primitive, and having an address 0 from the second primitive, would be triggered for evaluation, which would lead to a malfunction of the fluidic die.

Accordingly, the present specification describes a fluidic die that overcomes this, and other complications. Specifically, the present specification describes a fluidic die that includes primitives having at least a threshold number of fluid actuators. Next, the number of fluid actuators that is coupled to an actuator evaluator is set to be equal to or less than the primitive size. In so doing, it can be ensured that no more than one fluid actuator per actuator evaluator is evaluated at a time.

Specifically, the present specification describes a fluidic die. The fluidic die includes an array of fluid actuators grouped into primitives. An actuator evaluator of the fluidic die is coupled to a subset of the array of fluid actuators and a fluid actuator controller of the fluidic die groups multiple fluid actuators of the array of fluid actuators into primitives. In this example, a primitive size is greater than or equal to a threshold size and the subset of the array of fluid actuators coupled to the actuator evaluation device is less than or equal to the threshold primitive size.

In another example, a fluidic die includes an array of fluid actuators grouped into primitives and a number of actuator sensors to receive a signal indicative of a state of a fluid actuator. Each actuator sensor is coupled to a respective fluid actuator. The fluidic die also includes an actuator evaluator coupled to a subset of the array of fluid actuators. The actuator evaluator evaluates an actuator state of any fluid actuator within the subset and generates an output indicative of the actuator state. A fluid actuator controller groups multiple fluid actuators of the array into primitives. In this example, a primitive size is greater than or equal to a threshold size, the subset of the array of fluid actuators coupled to the actuator evaluation device is less than or equal to the threshold primitive size, and primitive size varies.

The present application also describes a method. According to the method, a quantity of fluid actuators within a subset of an array of fluid actuators that are coupled to an actuator evaluator is determined. A minimum primitive size set, which minimum primitive size is greater than or equal to the quantity of fluid actuators within the subset. A fluid actuator of the primitive is then activated to generate a first voltage measured at a corresponding fluid actuator sensor and a state of the fluid actuator is evaluated at the actuator evaluator based on a comparison of the first voltage and a threshold voltage.

In one example, using such a fluidic die 1) allows for actuator evaluation circuitry to be included on a die as opposed to sending sensed signals to actuator evaluation circuitry off die; 2) increases the efficiency of bandwidth usage between the device and die; 3) reduces computational overhead for the device in which the fluid ejection die is disposed; 4) provides improved resolution times for malfunctioning actuators; 5) allows for actuator evaluation in one primitive while allowing continued operation of actuators in another primitive; and 6) places management of nozzles on the fluid ejection die as opposed to on the printer in which the fluid ejection die is installed, and 7) accommodates for variation in primitive size. However, it is contemplated that the devices disclosed herein may address other matters and deficiencies in a number of technical areas.

As used in the present specification and in the appended claims, the term "actuator" refers a nozzle or another non-ejecting actuator. For example, a nozzle, which is an actuator, operates to eject fluid from the fluid ejection die. A recirculation pump, which is an example of a non-ejecting actuator, moves fluid through the fluid slots, channels, and pathways within the fluid ejection die.

Accordingly, as used in the present specification and in the appended claims, the term "nozzle" refers to an individual component of a fluid ejection die that dispenses fluid onto a surface. The nozzle includes at least an ejection chamber, an ejector, and a nozzle orifice.

Further, as used in the present specification and in the appended claims, the term "fluidic die" refers to a component of a fluid ejection system that includes a number of fluid actuators. Groups of fluid actuators are categorized as "primitives" of the fluidic die, the primitive having a size referring to the number of fluid actuators grouped together. In one example, a primitive size may be between 8 and 16.

The fluid ejection die may be organized first into two columns with 30-150 primitives per column.

Still further, as used in the present specification and in the appended claims, the term "actuation event" refers to a concurrent actuation of fluid actuators of the fluidic die to thereby cause fluid displacement.

Even further, as used in the present specification and in the appended claims, the term "a number of" or similar language is meant to be understood broadly as any positive number including 1 to infinity.

Turning now to the figures, FIG. 1 is a diagram of a fluidic die (100) with a primitive (110) size greater than or equal to a fluid actuator (106) subset, according to an example of the principles described herein. As described above, the fluidic die (100) is part of a fluid ejection system that houses components for ejecting fluid and/or transporting fluid along various pathways. The fluid that is ejected and moved throughout the fluidic die (100) can be of various types including ink, biochemical agents, and/or fusing agents. The fluid actuators (106) may be arranged as an array (102). While FIG. 1 depicts 12 fluid actuators (106-1, 106-2, 106-3, 106-4, 106-5, 106-6, 106-7, 106-8, 106-9, 106-10, 106-11, 106-12) in the array (102), any number of fluid actuators (106) may be formed on the fluidic die (100). Within the figures, the indication "-*" refers to a specific instance of a component. For example, a first fluid actuator is identified as (106-1). By comparison, the absence of an indication "-*" refers to the component in general. For example, an actuator in general is referred to as a fluid actuator (106).

The fluid actuators (106) may be of varying types. For example, the fluidic die (100) may include an array of nozzles, wherein each nozzle includes a fluid actuator (106) that is an ejector. In this example, a fluid ejector, when activated, ejects a drop of fluid through a nozzle orifice of the nozzle.

Another type of fluid actuator (106) is a recirculation pump that moves fluid between a nozzle channel and a fluid slot that feeds the nozzle channel. In this example, the fluidic die includes an array of microfluidic channels. Each microfluidic channel includes a fluid actuator (106) that is a fluid pump. In this example, the fluid pump, when activated, displaces fluid within the microfluidic channel. While the present specification may make reference to particular types of fluid actuator (106), the fluidic die (100) may include any number and type of fluid actuators (106).

The fluidic die (100) also includes an array of actuator evaluators (104). Each actuator evaluator (104-1, 104-2, 104-3, 104-4) is coupled to a subset of the array (102) of fluid actuators (106). For example, a first actuator evaluator (104-1) is coupled to a subset that includes a first through third fluid actuators (106-1, 106-2, 106-3). Following this example, the second actuator evaluator (104-2) is coupled to the fourth through sixth fluid actuators (106-4, 106-5, 106-6), the third actuator evaluator (104-3) is coupled to the seventh through ninth fluid actuators (106-7, 106-8, 106-9), and the fourth actuator evaluator (104-4) is coupled to the tenth through twelfth fluid actuators (106-10, 106-11, 106-12).

The actuator evaluators (104) evaluate a state of any fluid actuator (106) within the subset that pertains to that actuator evaluator (104) and generates an output indicative of the fluid actuator (106) state. For example, the first actuator evaluator (104-1) can evaluate a state of any of the first fluid actuator (106-1), the second fluid actuator (106-2), and the third fluid actuator (106-3).

The fluidic die (100) also includes a fluid actuator controller (108) to group multiple fluid actuators (106) of the array of fluid actuators (106) into primitives (110). Note that the primitive (110) grouping may not align with the group of fluid actuators (106) that are coupled to an actuator evaluator (104). As described above, a primitive (110) refers to a grouping of fluid actuators (106), where each fluid actuator (106) within the primitive (110) has a unique address. In FIG. 1, the unique address or each fluid actuator (106) is indicated. For example, within the first primitive (110-1), the first fluid actuator (106-1) has an address of 0, the second fluid actuator (106-2) has an address of 1, the third fluid actuator (106-3) has an address of 2, and the fourth fluid actuator (106-4) of the primitive (110-1) has an address of 3. Similarly, the fluid actuators (106) that are grouped into the second and third primitive (110-2, 110-3) respectively, have similar addressing.

A quantity of fluid actuators (106) within the primitive (110) that can be concurrently fired may be designated. For example, it may be designated that in a given primitive (110), one fluid actuator (106) is enabled at a time.

At all times, the number of fluid actuators (106) in a primitive (110), which may be referred to as the primitive (110) size, is greater than or equal to a threshold value. This threshold size is greater than or equal to the subset of fluid actuators (106) that is coupled to an actuator evaluator (104). For example, as described above, the primitive size may vary. However, a lower limit is set for the primitive (110) size. This lower limit may be greater than or equal to the number of fluid actuators (106) that are grouped with a particular actuator evaluator (104). In so doing, it can be assured that no more than one fluid actuator (106) per actuator evaluator (104) is evaluated at a given time.

For example, if the threshold number is four, then a primitive (110) size may be greater than or equal to four and the number of fluid actuators (106) grouped with a particular actuator evaluator (104) would be four or fewer. This reduces the chance of fluidic die (100) malfunction. For example, if the number of fluid actuators (106) coupled to an actuator evaluator (104) was greater than the threshold, for example five, there is a chance that multiple fluid actuators (106) per actuator evaluator (104) could be activated for evaluation, which would lead to fluidic die (100) malfunction.

For example, suppose the addresses for fluid actuators in the primitives (110) is 0, 1, 2, and 3, and five fluid actuators (106) are paired with each actuator evaluator (104), there is a possibility, that a fluid actuator (106-1) with address 0 from a first primitive (110-1) and an actuator (106) with an address 0 from an adjacent primitive (110-2) may both be selected for evaluation, and both may be coupled to the first actuator evaluator (104-1). Evaluating multiple fluid actuators (106) at a time may be beyond the capabilities of the actuator evaluators (104), and therefore would result in a malfunction of the actuator evaluator (104).

By comparison, if the number of fluid actuators (106) coupled to an actuator evaluator (104) is less than to or equal to the threshold as depicted in FIG. 1, for example three, there is no chance that multiple fluid actuators (106) coupled to a particular actuator evaluator (104) will be evaluated at the same time as long as no more than one fluid actuator (106) per primitive (110) is actuated for a particular actuation event.

In this example, less than all of the actuator evaluators (104) may be active at a given time. For example, if those fluid actuators (106) having an address of 1 are selected for evaluation then the third actuator evaluator (104-3) would be inactive, as it is not grouped with a fluid actuator (106) having a "1" address.

Accordingly, a fluidic die (100) that has the quantity of fluid actuators (106) coupled to a single actuator evaluator (104) being less than or equal to the lower limit threshold primitive (110) size, assures that, regardless of the primitive (110) size, which may change, at most a single fluid actuator (106) per actuator evaluator (104) will be processed for evaluation.

Figure 2:
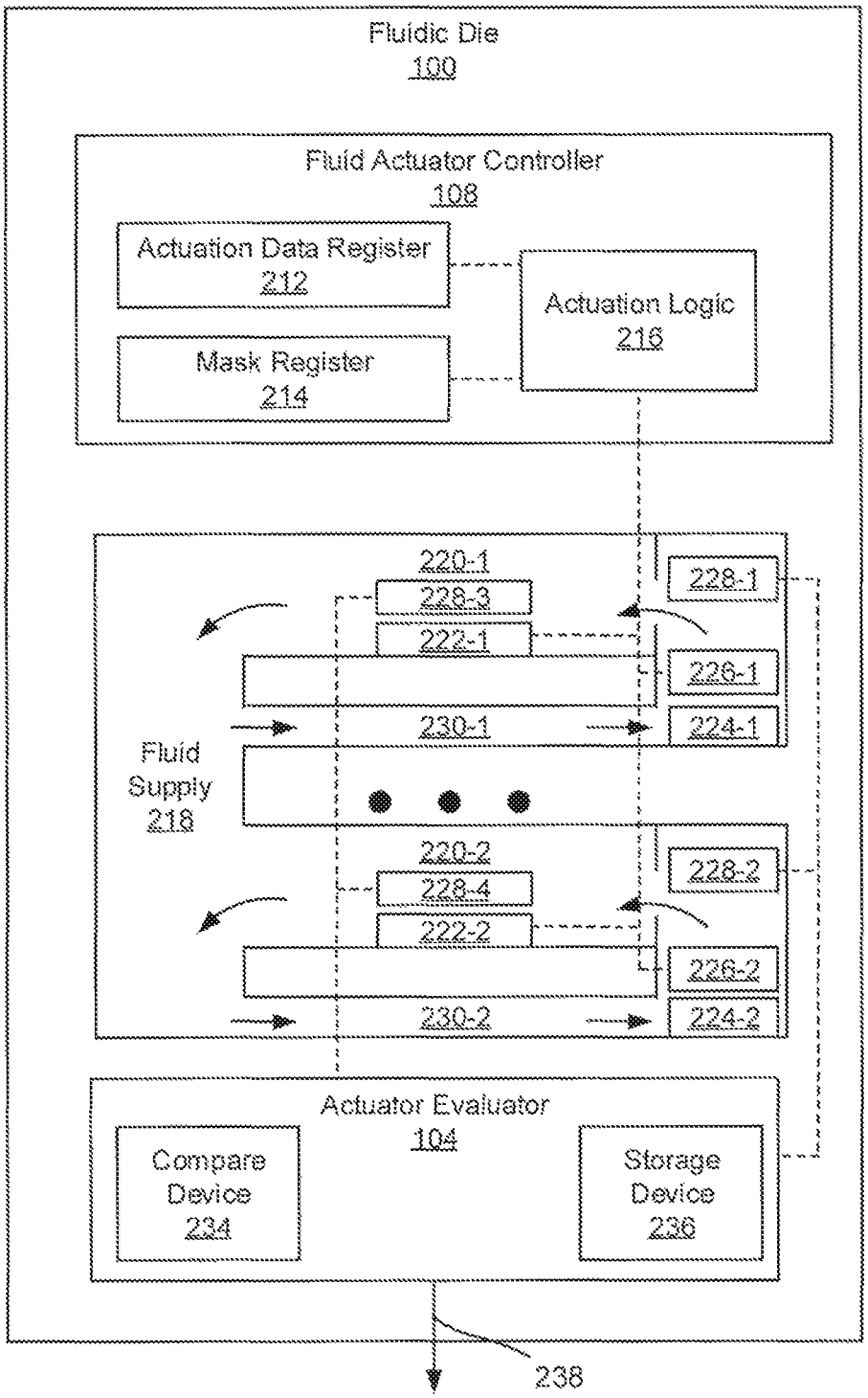
FIG. 2 is a diagram of a fluidic die with a primitive size greater than or equal to an evaluator subset, according to another example of the principles described herein.

FIG. 2 is a diagram of a fluidic die (100) with a primitive (FIG. 1, 110) size greater than or equal to a fluid actuator (FIG. 1, 106) subset, according to another example of the principles described herein. Specifically, FIG. 2 depicts the fluid actuator controller (108) and one subset of fluid actuators (FIG. 1, 106) coupled to an actuator evaluator (104). While FIG. 2 depicts two structures, a primitive (FIG. 1, 110) may include any number of structures. In FIG. 2, fluid flow throughout the fluidic die (100) is indicated by the arrows.

As described above, the fluid actuators (FIG. 1, 106) may take many forms. For example, the fluidic die (100) may include a plurality of nozzles, where each nozzle includes an ejection chamber, a nozzle orifice (224), and a fluid actuator (FIG. 1, 106) in the form of a fluid ejector (226). As shown, each nozzle may be fluidly connected to a fluid supply (218) via a fluid input (230). In addition, each nozzle may be fluidly connected to the fluid supply (218) via a microfluidic channel (220) in which a fluid actuator (FIG. 1, 106) in the form of a fluid pump (222) is disposed.

In this example, fluid is conveyed to the ejection chamber of each nozzle via the respective fluid input (230-1, 230-2). Actuation of the fluid ejectors (226-1, 226-2) of each nozzle may displace fluid in the ejection chamber in the form of a fluid drop ejected via the nozzle orifices (224-1, 224-2). Furthermore, fluid may be circulated from the ejection chamber back to the fluid supply (218) via microfluidic channels (220-1, 220-2) by operation of the fluid pumps (222-1, 222-2) disposed therein.

Accordingly, in such examples actuation of the fluid actuators (FIG. 1, 106) (e.g., fluid ejectors (226) and fluid pumps (222)) is carried out by the fluid actuator controller (108). In this example, the fluid actuator controller (108) includes components to manage the actuation of the various fluid actuators (FIG. 1, 106). For example, the fluid actuator controller (108) includes an actuation data register (212) and a mask register (214).

The actuation data register (212) stores actuation data that indicates each fluid actuator (FIG. 1, 106) to actuate for a set of actuation events. The mask register (214) stores mask data that indicates fluid actuators (FIG. 1, 106) of the array enabled for actuation for a particular actuation event of the set of actuation events. That is, the mask register (212) indicates a set of particular actuation event of the set of actuation events.

The fluid actuator controller (108) also includes actuation logic (216). The actuation logic (216) is coupled to the actuation data register (212) and the mask register (214) to determine which fluid pumps (222) and fluid ejectors (226) to actuate for a particular actuation event. The actuation logic (216) is also coupled to the fluid pumps (222) and fluid ejectors (226) to electrically actuate those fluid actuators (FIG. 1, 106) selected for actuation based on the actuation data register (212) and the mask register (214).

Once a particular fluid actuator (FIG. 1, 106), i.e., fluid pump (222) or fluid ejector (226), has been activated, a corresponding sensor (228-1, 228-2, 228-3, 228-4) collects information regarding the state. For example, in a drive bubble detection system, the sensors (228-1, 228-2, 228-3, 228-4) detect a voltage, and pass the corresponding voltage to the actuator evaluator (104) for state determination. That is, the actuator evaluator (104) can determine a state, for example failing or operational, of any fluid actuator (FIG. 1, 106) coupled thereto. Note, that as depicted in FIG. 2, in some examples, the actuator sensors (228) are uniquely paired with a corresponding fluid actuator (FIG. 1, 106), i.e., fluid pump (222) and/or fluid ejector (226) and that a single actuator evaluator (104) is shared among all the fluid actuators (FIG. 1, 106) within the subset.

The actuator evaluator (104) includes various components to determine a state of the fluid actuator (FIG. 1, 106). For example, the actuator evaluator (104) may include a compare device (234) to compare an output of an actuator sensor (228) coupled to a respective fluid actuator (FIG. 1, 106) against a threshold value to determine when the respective fluid actuator (FIG. 1, 106) is malfunctioning. That is, the compare device (234) determines whether the output of the actuator sensor (228), $V_o$, is greater than or less than the threshold voltage, $V_{th}$. The compare device (234) then outputs a signal indicative of which is greater.

The output of the compare device (234) may then be passed to a storage device (236) of the actuator evaluator (104). In one example, the storage device (236) may be a latch device that stores the output of the compare device (234) and selectively passes the output on. While FIG. 2 depicts the storage device (236) in the actuator evaluator (104). In some examples, the storage device (236) may be disposed elsewhere, for example on a line leading out of the actuator evaluator (104).

In some examples, the output line (238) is a shared line along which outputs of multiple actuator evaluators (104) are passed. That is, the output line (238) may be a single wire or bus of wires that is connected to all actuator evaluators (104). This output line (238) may be coupled to a sample device. In this example, the actuator evaluators (104) are controlled such that one actuator evaluator (104) actively drives its sample voltage on the output line (238) at a time. Still further, the sample device (250) receive and stores the sample voltage at the appropriate time.

The output line (238) may transmit various pieces of information regarding a state of the evaluated fluid actuator (FIG. 1, 106). In one example, just an output of the actuator sensor (228) is passed along the output line (238) and a subsequent controller may include components to associate a particular actuation event with the corresponding evaluation event. That is, there is a built in delay between actuation of a particular fluid actuator (FIG. 1, 106) and evaluation of that fluid actuator (FIG. 1, 106). This delay may be on the order of 10 microseconds. However, other fluid actuators (FIG. 1, 106) may be actuated multiple times during that delay. Accordingly, to ensure accurate evaluation, there should be an association between an actuation and the evaluation resulting from the actuation. Accordingly, the output line (238) may pass just the evaluation results, and a subsequent controller may perform calculations to determine the association.

In another example, in addition to passing the evaluation results, the output line (238) may pass an identification of the actuator (FIG. 1, 106) that was evaluated. In other words, the actuator evaluator (104) associates the state of the fluid actuator (FIG. 1, 106) with an address of the fluid actuator (FIG. 1, 106). In this example, a downstream controller would not have to perform the calculations to determine the association.

Figure 3:
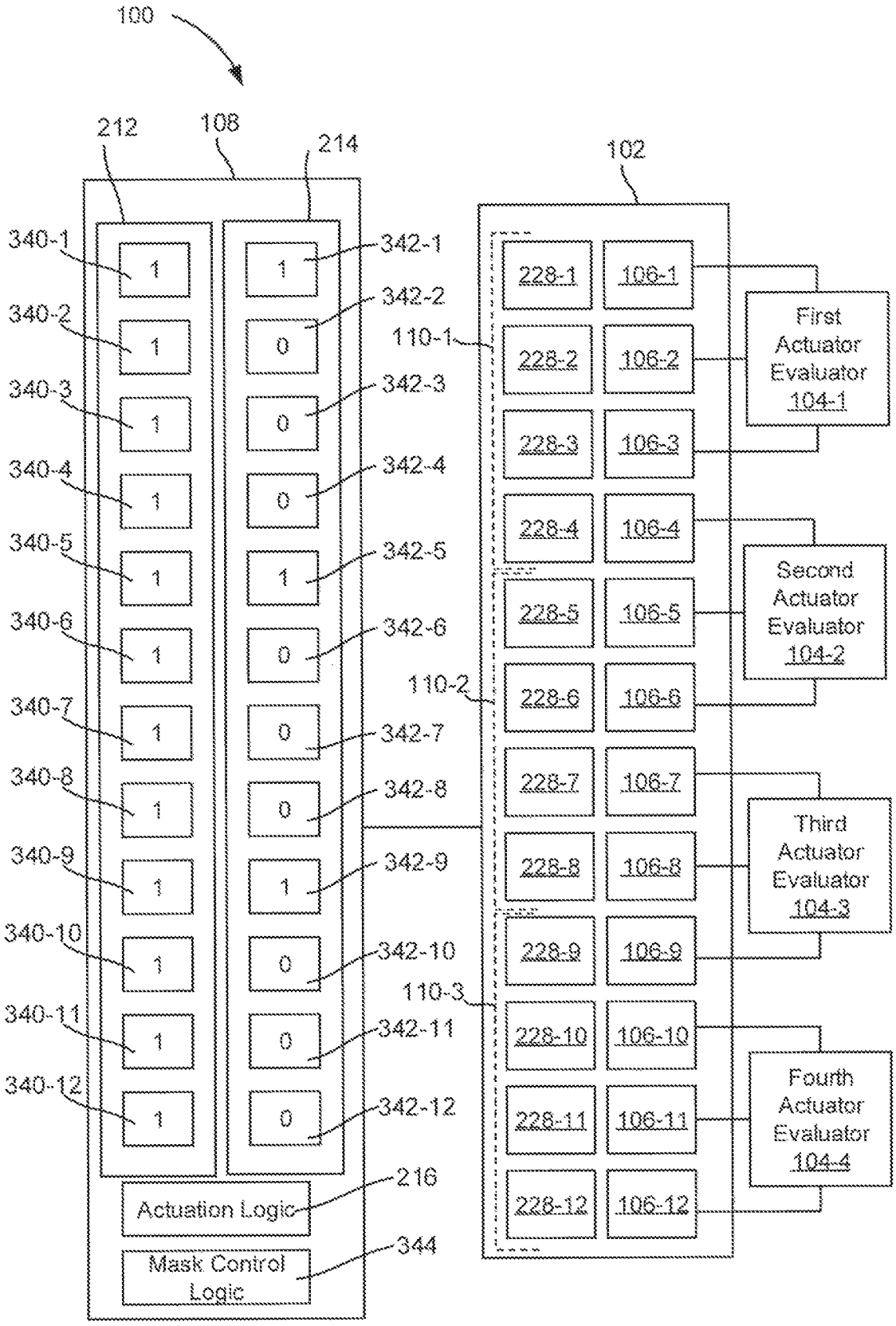
FIG. 3 is a diagram of a fluidic die with a primitive size greater than or equal to an evaluator subset, according to another example of the principles described herein.

FIG. 3 is a diagram of a fluidic die (100) with a primitive (110) size greater than or equal to a fluid actuator (106) subset, according to another example of the principles described herein. Specifically, FIG. 3 depicts the fluid actuator controller (108) and multiple primitives (110-1, 110-2, 110-3) and multiple actuator evaluators (104-1, 104-2, 104-3, 104-4). In this example the fluidic die (100) includes an array of actuator sensors (228) to receive a signal indicative of a state of a corresponding fluid actuator (106). As depicted in FIG. 3, each actuator sensor (228) is coupled to a respective fluid actuator (106). That is, the actuator sensors (228) sense a state of a corresponding fluid actuator (106). As a specific example, the actuator sensors (228) may be drive bubble detectors that detect the presence of a drive bubble within an ejection chamber of a nozzle.

A drive bubble is generated by a fluid actuator (106) to move fluid. For example, in thermal inkjet printing, a thermal ejector heats up to vaporize a portion of fluid in an ejection chamber. As the bubble expands, it forces fluid out of the nozzle orifice (FIG. 2, 224). As the bubble collapses, a negative pressure within the ejection chamber draws fluid from the fluid feed slot of the fluidic die (100). Sensing the proper formation and collapse of such a drive bubble can be used to evaluate whether a particular fluid actuator (FIG. 1, 106) is operating as expected. That is, a blockage in the nozzle will affect the formation of the drive bubble. If a drive bubble has not formed as expected, it can be determined that the nozzle is blocked and/or not working in the intended manner.

The presence of a drive bubble can be detected by measuring impedance values within the ejection chamber at different points in time. That is, as the vapor that makes up the drive bubble has a different conductivity than the fluid that otherwise is disposed within the chamber, when a drive bubble exists in the ejection chamber, a different impedance value will be measured. Accordingly, a drive bubble detection device measures this impedance and outputs a corresponding voltage. As will be described below, this output can be used to determine whether a drive bubble is properly forming and therefore determining whether the corresponding nozzle or pump is in a functioning or malfunctioning state. This output can be used to trigger subsequent fluid actuator (106) management operations. While description has been provided of an impedance measurement, other characteristics may be measured to determine the characteristic of the corresponding fluid actuator (106).

The drive bubble detection devices may include a single electrically conductive plate, such as a tantalum plate, which can detect impedance of whatever medium is within the ejection chamber. Specifically, each drive bubble detection device measures an impedance of the medium within the ejection chamber, which impedance measure can indicate whether a drive bubble is present in the ejection chamber. The drive bubble detection device then outputs a first voltage value indicative of a state, i.e., drive bubble formed or not, of the corresponding fluid actuator (106). This output can be compared against a threshold voltage to determine whether the fluid actuator (106) is malfunctioning or otherwise inoperable.

As described above, in some examples such as that depicted in FIG. 3, each actuator sensor (228) of the number of actuator sensors (228) may be coupled to a respective fluid actuator (106) of the number of fluid actuators (106). In one example, each actuator sensor (228) is uniquely paired with the respective actuator (106).

FIG. 3 also depicts the fluid actuator controller (108). In this example, the fluid actuator controller (108) includes components to manage the actuation of the various fluid actuators (106). For example, the fluid actuator controller includes an actuation data register (212) and a mask register (214).

The actuation data register (212) stores actuation data that indicates each fluid actuator (106) to actuate for a set of actuation events. For example, the actuation data register (212) may include a set of bits (340-1 through 340-12) to store actuation data, where each respective bit (340-1 through 340-12) of the actuation data register (212) corresponds to a respective fluid actuator (106-1 through 106-12). The actuation data register (212) indicates each fluid actuator (106) to actuate for a set of actuation events. For example, for those fluid actuators (106) that are to be actuated for a set of actuation events, the corresponding respective bit (340-1 through 340-12) can be set to "1." For those fluid actuators (106) that are not to be actuated for the set of actuation events, the corresponding respective bit (340-1 through 340-12) can be set to "0." In the example depicted in FIG. 3, all of the fluid actuators (106) have been activated for a set of actuation events as indicated by each having the respective bit (340-1 through 340-12) value set to "1."

The mask register (214) stores mask data that indicates fluid actuators (106) of the array enabled for actuation for a particular actuation event of the set of actuation events. That is, the mask register (214) indicates a set of fluid actuators (106) of the array that are actively enabled for actuation for a respective actuation event of the set of actuation events. For example, for those fluid actuators (106) that are to be actuated for a particular actuation event, the corresponding respective bit (342-1 through 342-12) can be set to "1." For those fluid actuators (106) that are not to be actuated for the particular actuation events, the corresponding respective bit (342-1 through 342-12) can be set to "0." In so doing, the mask register (214) configures the size of the primitives (110). That is, the mask register (214) identifies the first fluid actuator (106-1), a fifth fluid actuator (106-5), and a ninth fluid actuator (106-9) to be activated for a particular actuation event. Accordingly, the primitive (110) size is established by the mask register (214) to be four fluid actuators. Note that over time, the primitive (110) size may change based on the information presented in the mask register (214). That is the primitive size (110) is not fixed.

In this example, a threshold for the minimum primitive size (110) may be set. For example, the minimum threshold size may be 4, as depicted in FIG. 3. This threshold size is based on the number of fluid actuators (106) that are grouped to corresponding actuator evaluators (104). For example, the threshold size is equal to or greater than the number of fluid actuators (106) that are grouped to the actuator evaluators (104). Doing so ensures that there will at most be one fluid actuator (106) selected per actuator evaluator (104) to be evaluated.

The fluid actuator controller (108) also includes actuation logic (216). The actuation logic (216) is coupled to the actuation data register (212) and the mask register (214) to determine which fluid actuators (106) to actuate for a particular actuation event. The actuation logic (216) is also coupled to the fluid actuators (106) to electrically actuate those fluid actuators (106) selected for actuation based on the actuation data register (212) and the mask register (214).

The fluid actuator controller (108) also includes mask control logic (344) to shift mask data stored in the mask register (214) responsive to the performance of a particular actuation event of a set of actuation events. By shifting the mask data, different fluid actuators (106) are indicated for actuation of a subsequent actuation event of the set of actuation events. To effectuate such shifting, the mask control logic (344) may include a shift count register to store a shift pattern that indicates a number of shifts that are input into the mask register and a shift state machine which inputs a shift clock to cause the shifting indicated in the shift count register.

Figure 4:
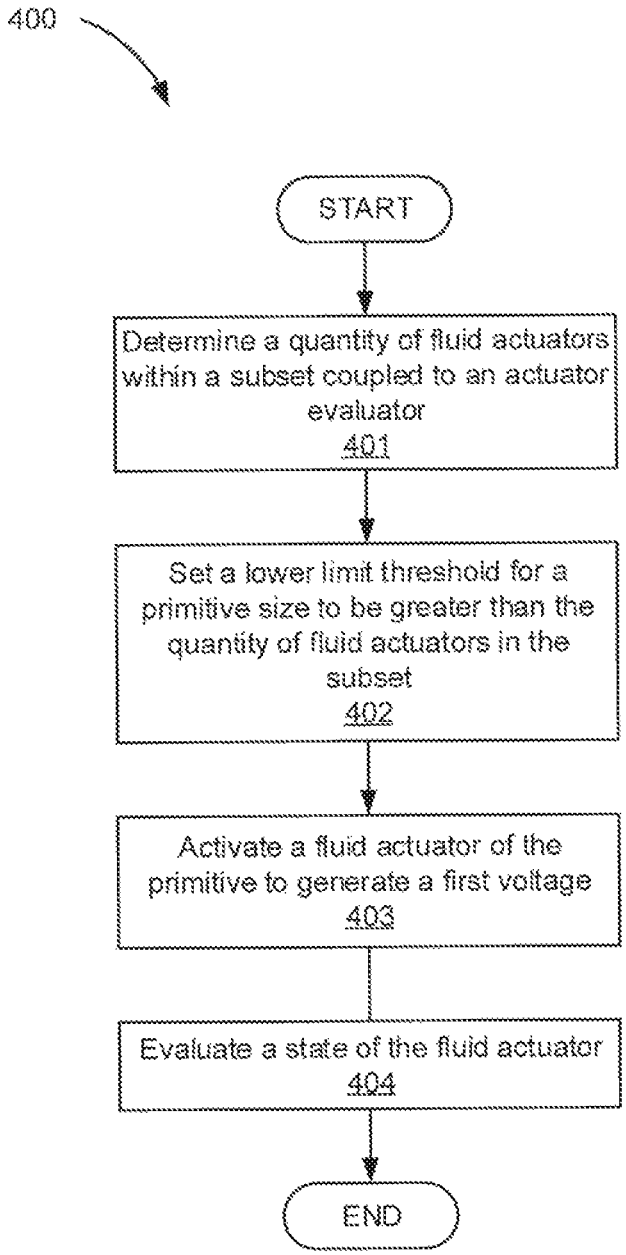
FIG. 4 is a flow chart of a method for controlling fluid actuators, according to an example of the principles described herein.

FIG. 4 is a flow chart of a method (400) for controlling fluid actuators (FIG. 1, 106), according to an example of the principles described herein. According to the method (400), a subset of fluid actuators (FIG. 1, 106) is grouped to an actuator evaluator (FIG. 1, 104), and a quantity of fluid actuators (FIG. 1, 106) in that subset is determined (block 401). As described above, fluid actuators (FIG. 1, 106) are grouped into primitives (FIG. 1, 110) to carry out printing operations. According to the method (400), a lower limit threshold is set (block 402) for the number of fluid actuators (FIG. 1, 106) for a primitive (FIG. 1, 110), i.e., a lower limit for the primitive (FIG. 1, 110) size. That is, while the primitive (FIG. 1, 110) size may vary, a lower limit is set such that there are always more, or the same number of, fluid actuators (FIG. 1, 106) in a primitive (FIG. 1, 110) then there are fluid actuators (FIG. 1, 106) associated with an actuator evaluator (FIG. 1, 104).

Next, a fluid actuator (FIG. 1, 106) is activated (block 403). For example, in thermal inkjet printing, the heating element in a thermal ejector is heated so as to generate a drive bubble that forces fluid out the nozzle orifice (FIG. 2, 224). Doing so generates a sense voltage output by the corresponding actuator sensor (FIG. 2, 228), which output is indicative of an impedance measure at a particular point in time within the ejection chamber.

An actuator state is then evaluated (block 404) based at least in part on a comparison of the sense voltage and the threshold voltage. For example, in some cases multiple instances of a sense voltage are collected and compared against one or more corresponding threshold voltages. The results of the different comparisons are combined to form an actuator signature, which is used to assess fluid actuator (FIG. 1, 106) health.

In this example, the threshold voltages may be selected to clearly indicate a blocked, or otherwise malfunctioning, fluid actuator (FIG. 1, 106). That is, the threshold voltages may correspond to an impedance measurement expected when a drive bubble is present in the ejection chamber, i.e., the medium in the ejection chamber at that particular time is fluid vapor. Accordingly, if the medium in the ejection chamber were fluid vapor, then the received sense voltage would be higher than the threshold voltage. By comparison, if the medium in the ejection chamber is print fluid such as ink, which may be more conductive than fluid vapor, the impedance would be lower, thus a lower voltage would be present. Accordingly, the threshold voltages are configured such that a voltage lower than the threshold indicates the presence of fluid, and a voltage higher than the threshold indicates the presence of fluid vapor. If the first voltage is thereby greater than the threshold voltage, it may be determined that a drive bubble is present and if the first voltage is lower than the threshold voltage, it may be determined that a drive bubble is not present when it should be, and a determination made that the fluid actuator (FIG. 1, 106) is not performing as expected. While specific reference is made to output a low voltage to indicate low impedance, in another example, a high voltage may be output to indicate low impedance.

Figure 5:
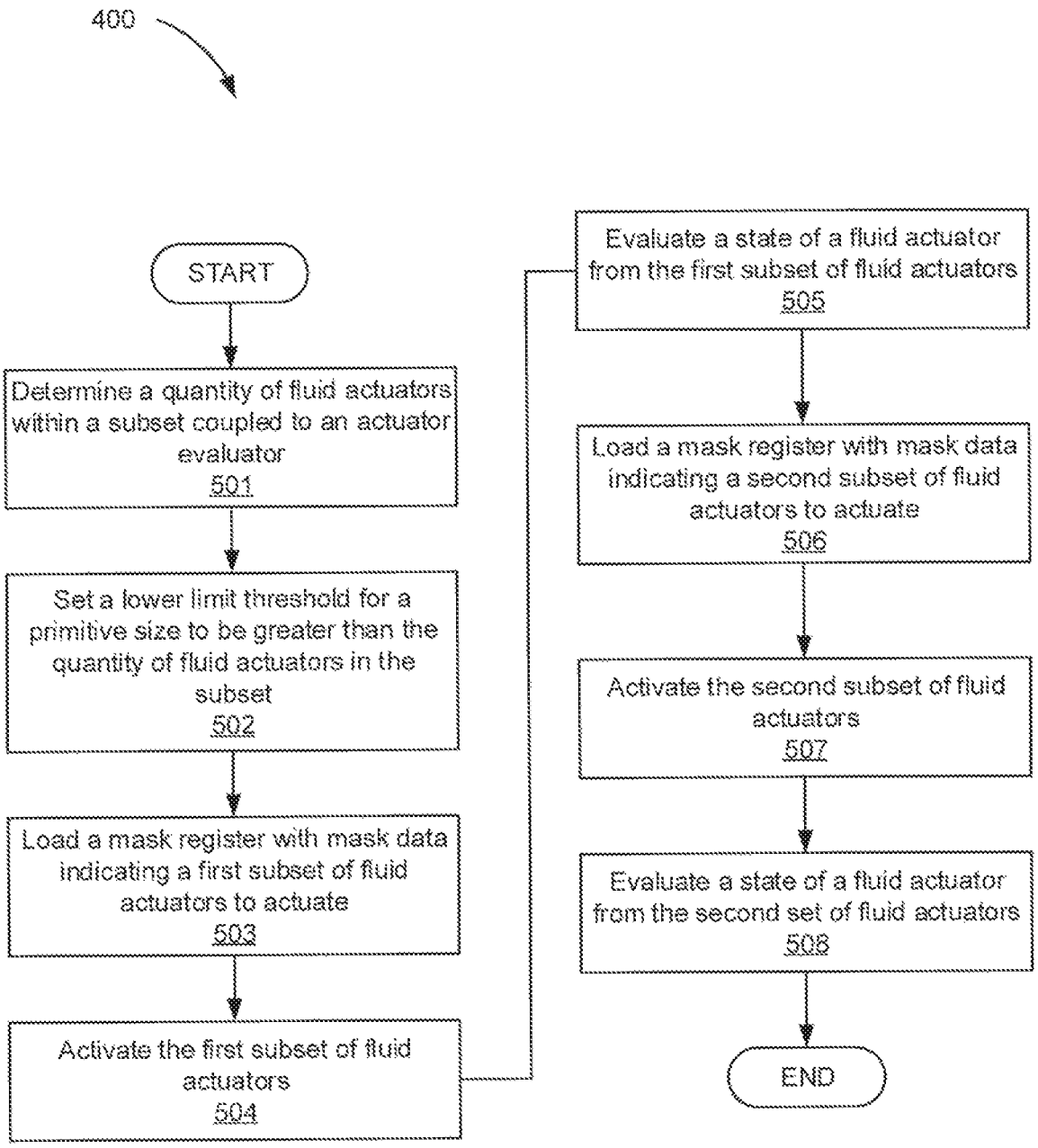
FIG. 5 is a flow chart of a method for controlling fluid actuators, according to an example of the principles described herein.

FIG. 5 is a flow chart of a method (500) for controlling fluid actuators (FIG. 1, 106), according to an example of the principles described herein. In the method (500), a quantity of fluid actuators (FIG. 1, 106) coupled to an actuator evaluator (FIG. 1, 104) is determined (block 501) and a lower limit threshold for a primitive (FIG. 1, 110) size is set (block 502) to be greater than or equal to the quantity of fluid actuators (FIG. 1, 106) grouped to an actuator evaluator (FIG. 1, 104). This may be done as described above in regards to FIG. 4.

A mask register (FIG. 2, 214) is loaded (block 503) with mask data indicating a first subset of fluid actuators (FIG. 1, 106) to actuate. That is, as described above, the mask register (FIG. 2, 214) includes bits that indicate which of the fluid actuators (FIG. 1, 106) are enabled for a particular actuation event. Accordingly, this information is loaded into the mask register (FIG. 2, 214). The first subset of fluid actuators (FIG. 1, 106) are then activated (block 504) and a state of a fluid actuator (FIG. 1, 106) from the first subset is evaluated (block 505) as described above in regards to FIG. 4.

Next, the mask data is shifted (block 506) to indicate a different, i.e., second, subset of fluid actuators (FIG. 1, 106) to actuate. For example, the mask data may first indicate that a first, fifth, and ninth actuator (FIG. 1, 106-1, 106-5, 106-9) are to be activated. Following this shift, the mask data may indicate a second subset, for example, a second, sixth, and tenth actuator (FIG. 1, 106-2, 106-6, 106-10) are to be activated. This second subset is then activated (block 507) and a state of a fluid actuator (FIG. 1, 106) from the second subset is evaluated (block 508) as described above in regards to claim 4.

In one example, using such a fluidic die 1) allows for actuator evaluation circuitry to be included on a die as opposed to sending sensed signals to actuator evaluation circuitry off die; 2) increases the efficiency of bandwidth usage between the device and die; 3) reduces computational overhead for the device in which the fluid ejection die is disposed; 4) provides improved resolution times for malfunctioning actuators; 5) allows for actuator evaluation in one primitive while allowing continued operation of actuators in another primitive; and 6) places management of nozzles on the fluid ejection die as opposed to on the printer in which the fluid ejection die is installed, and 7) accommodates for variation in primitive size. However, it is contemplated that the devices disclosed herein may address other matters and deficiencies in a number of technical areas.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluidic die comprising:

an array of fluid actuators grouped into primitives;

an array of actuator evaluators, each actuator evaluator coupled to a subset of the array of fluid actuators; and a fluid actuator controller to group multiple fluid actuators of the array of fluid actuators into primitives, wherein:

a primitive size is greater than or equal to a lower limit threshold; and the subset of the array of fluid actuators coupled to the actuator evaluation device is less than or equal to the lower limit threshold.

2. The fluidic die of claim 1, wherein:

the number of fluid actuators within the primitive varies; and the fluid actuator controller comprises an actuation data register to store actuation data that indicates each fluid actuator to actuate for a set of actuation events;

a mask register to store mask data that:

indicates a set of fluid actuators of the array enabled for actuation for a particular actuation event of the set of actuation events; and defines the primitive size;

actuation logic coupled to the actuation data register, the mask register, and the respective fluid actuators, the actuation logic to electrically actuate a subset of the fluid actuators based at least in part on the actuation data register and the mask register for the particular actuation event.

3. The fluidic die of claim 1, wherein the fluid actuator controller further comprises:

mask control logic to shift the mask data stored in the mask register responsive to performance of the particular actuation event to thereby indicate another subset of fluid actuators enabled for actuation for another actuation event of the set of actuation events.

4. The fluidic die of claim 1, further comprising a shared output line along which outputs of multiple actuator evaluators are passed.

5. The fluidic die of claim 4, wherein the actuator evaluators comprise a sample device to provide a sample voltage to the shared output line.

6. The fluidic die of claim 1, wherein:

the actuator evaluator comprises a compare device to compare an output of an actuator sensor coupled to a respective fluid actuator against a threshold value to determine when the respective fluid actuator is malfunctioning; and the fluidic die comprises a storage device to store the output of the compare device and to selectively pass the stored output.

7. The fluidic die of claim 1, wherein:

an actuator sensor is uniquely paired with a corresponding fluid actuator; and a single actuator evaluation device is shared among all the fluid actuators within the subset.

8. A fluidic die comprising:

an array of fluid actuators grouped into primitives;

a number of actuator sensors to receive a signal indicative of a state of a fluid actuator, wherein each actuator sensor is coupled to a respective fluid actuator;

an array of actuator evaluators wherein each actuator evaluator is coupled to a subset of the array of fluid actuators, to:

evaluate an actuator state of any fluid actuator within the subset; and generate an output indicative of the actuator state; and a fluid actuator controller to group multiple fluid actuators of the array into primitives, wherein:

a primitive size is greater than or equal to a lower limit threshold;

the subset of the array of fluid actuators coupled to the actuator evaluation device is less than or equal to the lower limit threshold; and the primitive size varies.

9. The fluidic die of claim 8, further comprising an array of nozzles, wherein:

each nozzle comprises a fluid actuator of the array of fluid actuators;

each fluid actuator is a fluid ejector which, when activated, ejects a drop of fluid through a nozzle orifice of the nozzle.

10. The fluidic die of claim 8, further comprising an array of microfluidic channels, wherein:

each microfluidic channel comprises a fluid actuator of the array of fluid actuators; and each fluid actuator is a fluid pump which, when activated, displaces fluid within the microfluidic channel.

11. The fluidic die of claim 8, wherein the actuator evaluator associates the state of the fluid actuator with an address of the fluid actuator.

12. A method comprising:

determining a quantity of fluid actuators within a subset of an array of fluid actuators, which subset are coupled to an actuator evaluator;

setting a lower limit threshold for a primitive size to be greater than or equal to the quantity of fluid actuators within the subset;

activating a fluid actuator of the primitive to generate a first voltage measured at a corresponding fluid actuator sensor; and evaluating a state of the fluid actuator at the actuator evaluator based on a comparison of the first voltage and a threshold voltage.

13. The method of claim 12, further comprising:

loading a mask register with mask data to indicate a first subset of fluid actuators to enable for actuation during a first actuation event of the set of actuation events; and activating the first subset of fluid actuators.

14. The method of claim 13, further comprising:

shifting the mask data to indicate a second subset of fluid actuators to enable for actuation during a second actuation event of the set of actuation events; and activating the second subset of fluid actuators.

15. The method of claim 12, wherein:

each fluid actuator within a primitive has a unique in-primitive address;

first fluid actuators from the multiple primitives have same unique in-primitive addresses; and second fluid actuators from each of the multiple primitives have the same in-primitive addresses.

* * * * *